United States Patent [19]

Fukuoka et al.

[11] 3,971,862

[45] July 27, 1976

[54] CONTINUOUS HOT-DIP GALVANIZING PROCESS FOR STEEL STRIP

[75] Inventors: Yoshikazu Fukuoka; Hiroshi Miwa, both of Fukuyama, Japan

[73] Assignee: Nippon Kokan Kabushiki Kaisha, Tokyo, Japan

[22] Filed: July 7, 1975

[21] Appl. No.: 593,186

Related U.S. Application Data

[63] Continuation of Ser. No. 386,575, Aug. 8, 1973, abandoned.

[30] Foreign Application Priority Data

Aug. 10, 1972 Japan ..... 47-79510

[52] U.S. Cl. ..... 427/329; 427/321; 427/398; 427/431

[51] Int. Cl.[2] ..... C23C 1/00

[58] Field of Search ..... 427/329, 321, 320, 431, 427/398 R

[56] References Cited

UNITED STATES PATENTS 3,619,247 11/1971 Newport ..... 427/329

*Primary Examiner*—Mayer Weinblatt
*Assistant Examiner*—Edith R. Buffalow
*Attorney, Agent, or Firm*—Flynn & Frishauf

[57] ABSTRACT

In a continuous hot-dip galvanizing process, the temperature of a travelling steel strip just before said strip is introduced into a molten Zn bath is controlled below the bath temperature, preferably at 380°C. to 420°C., to avoid generation of dross in said bath and impairment of said galvanized film.

3 Claims, 1 Drawing Figure

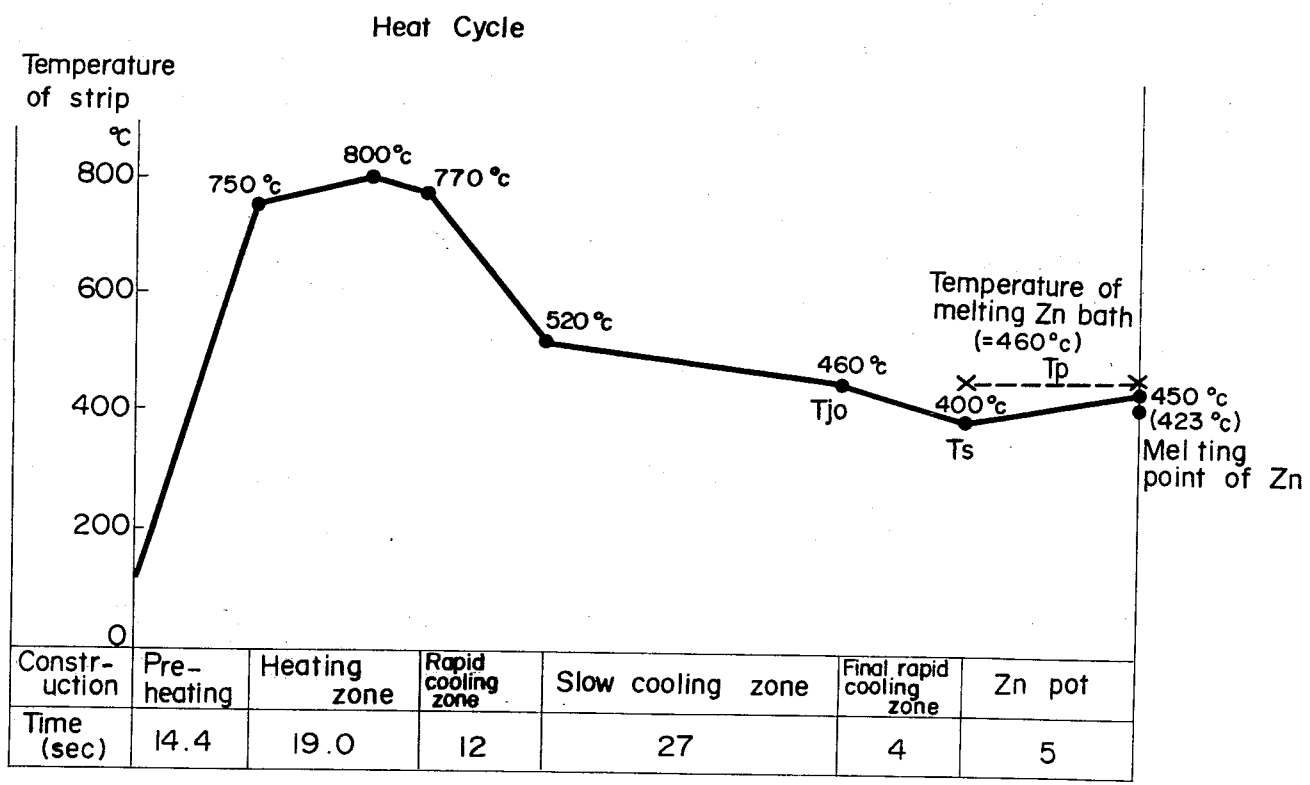
Heat Cycle
Temperature of strip
°C
800
600
400
200
0
750 °c
800 °c
770 °c
520 °c
460 °c
Tjo
Temperature of melting Zn bath (=460°c)
Tp
400 °c
Ts
450 °c (423 °c)
Melting point of Zn
Construction
Pre-heating
Heating zone
Rapid cooling zone
Slow cooling zone
Final rapid cooling zone
Zn pot
Time (sec)
14.4
19.0
12
27
4
5

CONTINUOUS HOT-DIP GALVANIZING PROCESS FOR STEEL STRIP

This is a continuation of application Ser. No. 386,575, filed Aug. 8, 1973 now abandoned.

The present invention relates to an improvement of a continuous hot-dip galvanizing process for steel strips, and more particularly a method of avoiding as much as possible generation of dross and of preventing impairment of the galvanized film.

Various methods have been proposed for a continuous hot-dip galvanizing process for steel strip and among them are known such methods as the Armco Sendzimir Process, shelf treatment process and non-oxidizing furnace type and the like. What is commonly found in all these prior processes known and practiced in the art is that the temperature of the strip as it is introduced into a molten Zn bath is, without exception, maintained at a higher temperature than that of the bath. That is to say, while the bath temperature is 450°C. to 460°C., the temperature of the strip when introduced into the bath is maintained at 460°C. to 520°C. This was perhaps attributable to the thermal efficiency considering the automatically maintainance of said bath temperature through such a steel strip temperature. Another cause that is responsible for this is that the temperature control of the strip in the slow cooling zone just before it is introduced into said bath is extremely difficult. As is well known in the art, the slow cooling mechanism for strips to be introduced to the bath is usually radiation cooling or natural cooling. In such a mechanism, it is self-evident that an introduction temperature of said strip into the bath is seldom controlled at an optimum value. Moreover, there are varied strip sizes and line speeds, which are changed very often, as inherent difficulties. In such changing factors, the above cooling mechanism is practically powerless. Said strip is passed through the bath at a very high speed. This is the reason why the temperature of a slow-cooled strip still remains in the upper portion of the 460°C. to 520°C. range as mentioned above.

We have confirmed that the disadvantages caused by said introducing a strip into said bath at a temperature in the upper portion of the 460°C. to 520°C. range cannot be disregarded. For instance, there is seen quite a large amount of dross generating in said bath. Said dross rapidly increases when the strip temperature is beyond about 475°C. This results in an increase in frequency of removing said dross and brings about a decrease in productivity. Secondly, the generation of said dross impairs said galvanized film, as a consequence of said dross building up on said film. Such a phenomenon is often seen and is little avoided. Thirdly, the strip temperature as mentioned above favors growth of the iron-zinc alloy layer of the stip. Needless to say formability of said galvanized steel is impaired by the above growth. While such disadvantages have been pointed out in the art, everybody has acquiesced in such defects as unavoidable phenomena accompanying the known continuous hot-dip galvanizing process.

The present invention has been developed to obviate such defects by improving the fundamentals of the known continuous hot-dip galvanizing process. The features of the present invention lie in a final rapid cooling just before a travelling strip is introduced into a molten zinc bath. That is, the travelling strip is rapidly cooled below said bath temperature, i.e. at most 460°C., preferably 380°C. to 420°C.

Thus, an object of the present invention is to provide a new continuous hot-dip galvanizing process in which little dross is generated.

Another object of the present invention is to provide a hot-dip galvanizing steel having sound galvanized film on which dross is not built up.

A further object of the present invention is to provide a hot-dip galvanized steel exhibiting good formability, i.e. there is not seen the unnecessary growth of an iron-zinc alloy layer in the steel.

Other objects and advantages will be apparent from the following description and with accompanying drawing in which:

The FIGURE is an example of typical heat cycle for the process of the present invention.

One example of a process to which this invention may be applied is given in a flow chart:

Pre-heating — heating & soaking — rapid cooling — slow cooling — final rapid cooling — hot-dip galvanizing.

In the above-mentioned process, the steps from pre-heating to slow cooling may be performed in the conventional manner, about which reference has been made. The above-mentioned flow chart follows a non-oxidizing type process wherein the steel strip, first, goes into the pre-heating zone of the continuous line and is heated up to approximately 750°C. It, then, progresses to a heating zone where it is heated up to approximately 800°C. Said strip goes on to enter the rapid cooling zone and is cooled to about 520°C., and then to the slow cooling zone where the strip is cooled near to a temperature of the molten zinc bath of about 460°C.

The above-mentioned process from the pre-heating to the slow cooling, i.e. said non-oxidizing type, can be replaced readily with other processes. That is, when the other process is the known Armco Sendzimir Type, it comprises an oxidizing furnace, a reducing furnace and an annealing furnace and the cooling zone; the heat cycle may also be in accordance with said process. If the known US Steel Process is employed, then the process and the heat cycle which characterize the said process may be used. Other systems such as Wheeling Steel Process or Selas Steel Process may also be used without any modification.

Against these processes, the improvement of this invention lies in the arranging of a final rapid cooling zone in which said travelling strip is cooled below said bath temperature, i.e. 300°C. to 460°C., preferably 380°C. to 420°C. As has been described before, the usual practice is that the bath temperature of said molten Zn bath is maintained continuously at about 460°C. The reason why the upper limit of the temperature of the strip introduced to said bath is set at about 460°C. is because strip temperatures above this value will cause dross generation due to a higher temperature than the bath temperature, and impairs quality of the galvanized film and formability of said steel. However, it is most desirable to finally rapid cool said strip to about 380°C. to 420°C. Thus the present invention provides a forced cooling in the final rapid cooling zone following the conventional slow cooling zone to lower the temperature of said strip below the bath temperature. In the conventional process, the bath temperature is maintained by the introduced strip of which its temperature is always higher than that of said bath. On the contrary, the strip being introduced to the bath in the present invention is heated by the bath temperature. Accordingly, said molten zinc bath requires positive heating-up in order to maintain its temperature at a required value.

This determines the final rapid cooling temperature of the strip; namely the lower limit at 300°C. If it is to be rapidly cooled to below 300C., then cooling of said molten Zn bath will proceed and increase the load on an external heating source which will bring about a loss in operation and cost. In view of this, the lower limit recommended is 380°C. Thus, the strip temperature to be introduced into said bath should be controlled at about 300°C. to 460°C. and more preferably at 380°C. to 420°C.

As has been discussed hereinabove, the optimum temperature for the steel strip is determined in the said final rapid cooling zone. Any type of rapid cooling mechanism may be used, but we have confirmed through out experiments that the mechanism used in the rapid cooling zone in any one of the conventional processes sufficiently meets our purpose. In other words, a combination of a cooler and a fan will suffice for said purpose. When there is a variation in the strip size or in the line speed, air flow passing through said cooler or revolution of said fan may be regulated to facilitate the temperature control of the strip. It is naturally possible to achieve the control by providing a damper or the like separately. In contrast to the above-mentioned slow cooling zone, the temperature control of the strip in the final rapid cooling zone may be performed quite securely, and it is quite easy to detect the strip temperature just before it goes into said bath and automatically control air flow passing through the cooler, the revolution speed of said fan and opening angle of said damper, etc., thereby. In sum, the control $\Delta J$ in said final rapid cooling zone is obtained by $T_{JO} - T_s$ $9(T_s < T_p)$ wherein the strip temperature coming into the said final cooling zone is $T_{JO}$, the molten Zn bath temperature, $T_p$, an optimum temperature of said strip leaving the final rapid cooling zone, $T_s$. This control $\Delta J$ is achieved without fail in accordance with the usual practice in the art.

The accompanying drawing shows one example of the present invention as applied to said non-oxidizing furnace type. This example indicates a heating cycle wherein the introduction temperature ($T_s$) of strip into said bath is 400°C. According to this cycle, the strip temperature ($T_{JO}$) at the entry side of the final rapid cooling zone is 460°C., and the bath temperature ($T_p$) is 460°C., so that the control in the final rapid cooling zone $\Delta J$ becomes 60°C. This is achieved in approximately 4 sec by the aforementioned cooling mechanism. Even if said $T_{JO}$ was unstable for some some reason, the control thereof becomes quite easy by detecting $T_s$ and the predetermined value of $T_s = 400°C$. may be maintained without fail. The strip comes into said bath at 400°C., passes through said bath of 460°C. in about 5 seconds and is heated therein up to approximately 450°C. and then travels on to the next stage.

As has been discussed, the steel strip is maintained without fail at the range of 460°C. $> T_s >$ 300°C., and more preferably range of 420°C. $> T_s >$ 380°C. Thus, a constant temperature of said strip at the entry side of the molten Zn bath exhibits great advantages for this invention. First of all, there was seen a remarkable decrease of said dross. In the conventional art, the accumulated dross on the bottom of said bath was 100 t to 120 t as against 70,000 t of production (t = ton). Whereas in the present invention, said quantity was surprisingly small or only 2 or 3 t per the same production amount. Thus, it becomes clear how dross increases as the strip temperature is increased. The effect of such remarkable dross quality of said galvanized film is truly great and there was not found a single instance of flows on said film caused thereby. Such defects on the film by the conventional art were as much as 700 – 800 t per 10,000 t production. That this should be reduced to almost zero, eloquently and clearly demonstrates the excellence of the process of the present invention. Another advantage of the present invention is that a stable film is obtained, since the introduction temperature of the strip into said bath is lower than that of said bath and is always constant and optimum; and there is no growth of iron-zinc alloy layer in steel, which makes stable formability of said galvanized steel.

We claim:

1. In a continuous hot-dip galvanizing process wherein a flux is omitted and wherein a steel strip is annealed in line in a heating furnace at a temperature of more than 750°C., and then the strip is slowly cooled in a furnace having a reducing atmosphere followed by introducing the strip to a molten zinc bath, the improvement which comprises subjecting said annealed strip to a final rapid cooling following said slow cooling to provide a temperature of the strip from 300° to 460°C. just before it is passed into the molten zinc bath, said temperature being below or equal to the temperature of zinc bath, whereby the formation of dross is substantially reduced.

2. The process of claim 1, wherein said strip is at a temperature of from 380°C. to 420°C. when introduced into said bath.

3. The process of claim 1, wherein said bath is at a temperature of about 460°C.

* * * * *